US006609444B1

(12) United States Patent
Hsien

(10) Patent No.: US 6,609,444 B1
(45) Date of Patent: Aug. 26, 2003

(54) SWITCHING LEVER FOR RATCHET TOOLS

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/289,320

(22) Filed: Nov. 7, 2002

(51) Int. Cl.[7] ..... B25B 13/46
(52) U.S. Cl. ..... 81/63.2; 81/63; 81/63.1
(58) Field of Search ..... 81/60, 61, 62, 81/63, 63.1, 63.2, 59.1, 58.4

(56) References Cited

U.S. PATENT DOCUMENTS 2,957,377 A * 10/1960 Hare ..... 81/63.2
3,436,992 A * 4/1969 Over et al. ..... 81/63.1
4,277,990 A * 7/1981 Hall ..... 81/63
6,050,165 A * 4/2000 Hall ..... 81/59.1
6,453,779 B2 * 9/2002 Hu ..... 81/63

* cited by examiner

*Primary Examiner*—Joseph J. Hail, III
*Assistant Examiner*—Hadi Shakeri
(74) *Attorney, Agent, or Firm*—Rosenberg, Klein & Lee

(57) ABSTRACT

A ratchet tool includes a head with a ratchet mechanism received therein which includes a pawl engaged with an engaging ring, and a switch member urges the pawl toward the engaging ring. A top plate is connected to the switch member and a lever extends from the top plate. The top plate closes an operation recess in the head, wherein the operation recess receives the switch member. A tilt ramp is connected between the outside of the head and the neck of the tool. The lever is located in parallel with the tilt ramp.

1 Claim, 5 Drawing Sheets

SWITCHING LEVER FOR RATCHET TOOLS

FIELD OF THE INVENTION

The present invention relates to a ratchet tool that includes a ratchet mechanism received in the head of the tool and a ramp is connected between the head and the neck of the tool. A switch lever is movably located on the ramp such that the grease is not stocked at the hole that the switch is located.

BACKGROUND OF THE INVENTION

A conventional ratchet tool 10 is shown in FIGS. 1 and 2, and generally includes a head 100 and an engaging ring 200 is rotatably received in a hole 130 defined in the head 100. The engaging ring 200 has toothed outer periphery 210 which is matched with a pawl 400 which is movably received in the head 100. A switch member 500 is rotatably inserted in a hole 150 defined in a side of the head 100 and includes a bead 600 biased by a spring 601 connected to the switch member 500. The bead 600 urges the pawl 400 toward the engaging ring 200 so that when the tool 10 is rotated in a first direction, the engaging ring 200 is rotated with the tool 10, and the engaging ring 200 is rotated independently from the rotation of the tool 10 when the tool 10 is rotated in a second direction. The switch member 500 has a lever 510 which is accessible from the outside of the tool 10 so that the user may push the lever 510 to control the pawl 400 and the direction that the tool 10 outputs a torque.

Nevertheless, the hole 150 in which the switch member 500 is inserted is easily be stocked by grease and dust which are brought to the switch member 500 and easily enter into the hole 150. The grease and dust become a hardened piece and makes the switch member to be hard to rotate.

The present invention intends to provide a ratchet tool that has a downward ramp connected to the head and the neck of the tool, and the lever of the switch member is arranged on the ramp so as to cover the hole from being stocked by the grease and dust.

SUMMARY OF THE INVENTION

In accordance with one aspect of the present invention, there is provided a ratchet tool which comprises a head with an engaging ring rotatably received in a through hole in the head and a pawl is movably received in the recess, a toothed side of the pawl is engaged with the toothed periphery of the engaging ring. An operation recess is defined in a side of the head and communicates with the recess. A height difference is defined between an outside of the head and a neck. A ramp is connected between the outside of the head and the neck of the tool. The ramp is tilt relative to the outside of the head and the neck.

A switch member has a cylindrical portion inserted in the operation recess and a passage is defined radially in the cylindrical portion of the switch member. A spring and a bead are received in the passage. The spring is engaged with a notch defined in a side opposite to the toothed side and the bead is engaged with one of two concavities defined in an inner periphery of the operation recess. A top plate is connected to an end of the cylindrical portion of the switch member and a diameter of the top plate is larger than that of the operation recess so as to cover the operation recess. A lever extends from the top plate at an angle such that the lever is located in parallel with the ramp with a tiny gap defined therebetween.

The primary object of the present invention is to provide a ratchet tool that has a lever for changing the direction of the tool to output a torque, the lever is located parallel with a tilt ramp connected between the head and the neck of the tool. The operation recess for receiving the switch member is well protected by the lever an the top plate of the switch member so as not to be blocked by grease and dust.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
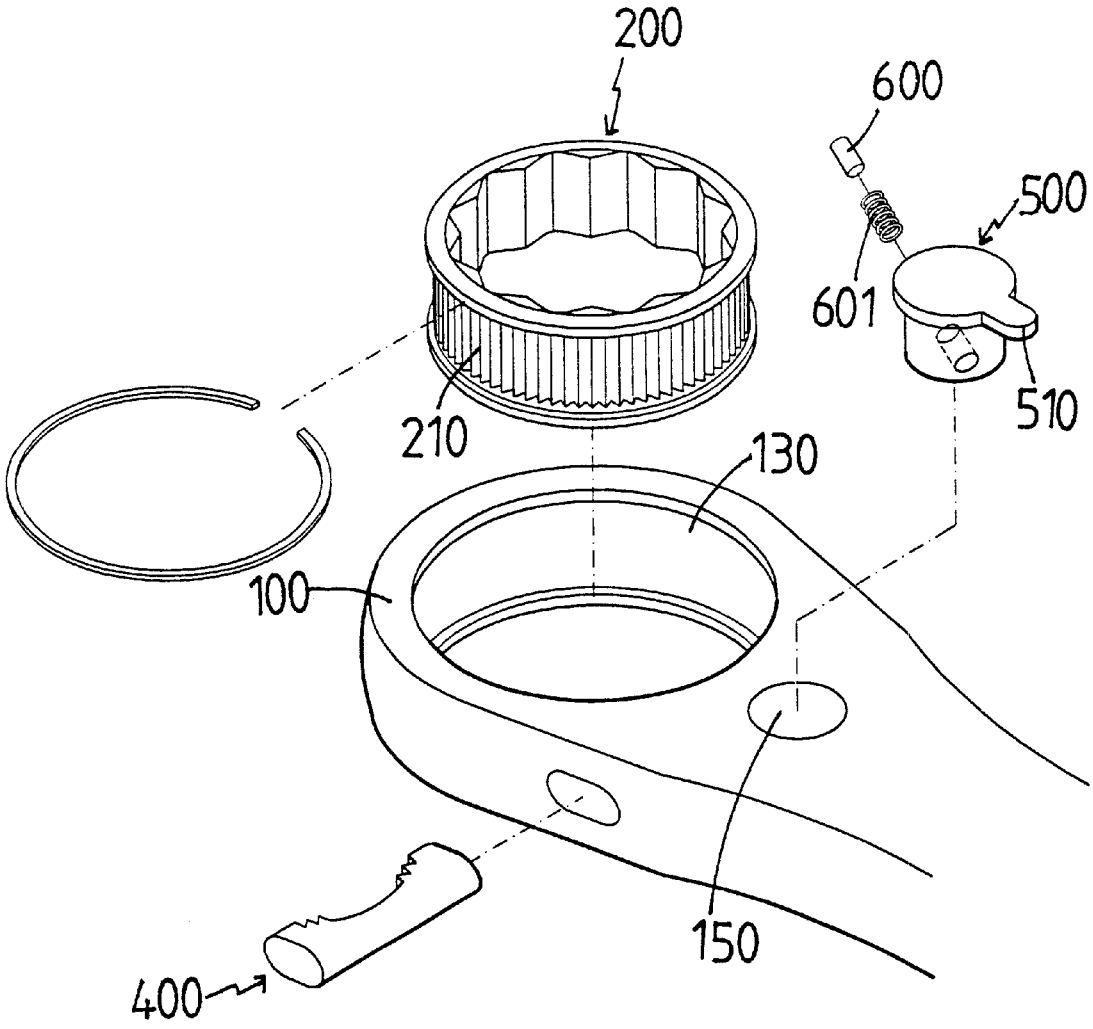
FIG. 1 PRIOR ART
FIG. 1 is an exploded view to show a conventional ratchet mechanism of the ratchet tool.
Figure 2:
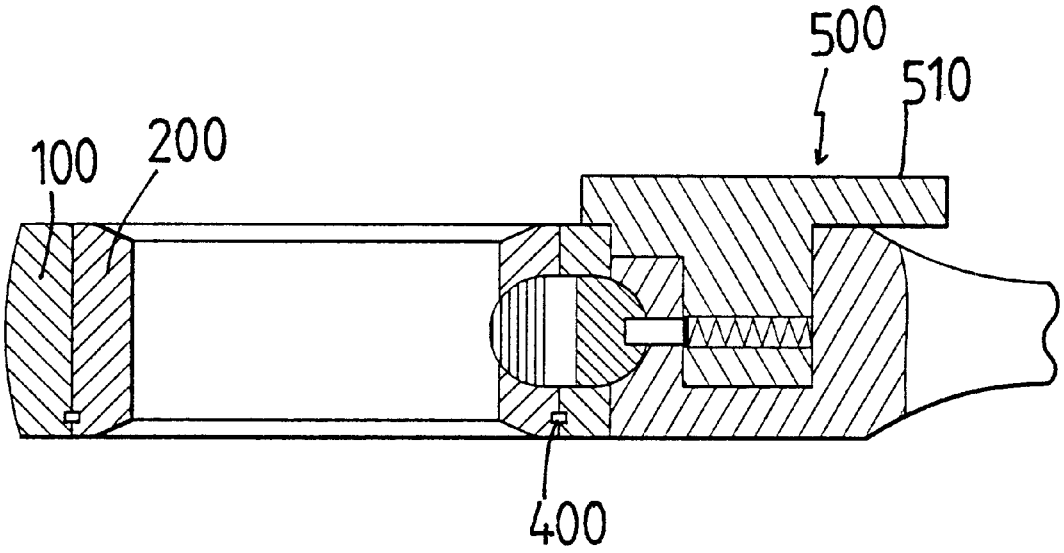
FIG. 2 PRIOR ART
FIG. 2 is a side cross sectional view to show the conventional ratchet mechanism of the ratchet tool.
Figure 3:
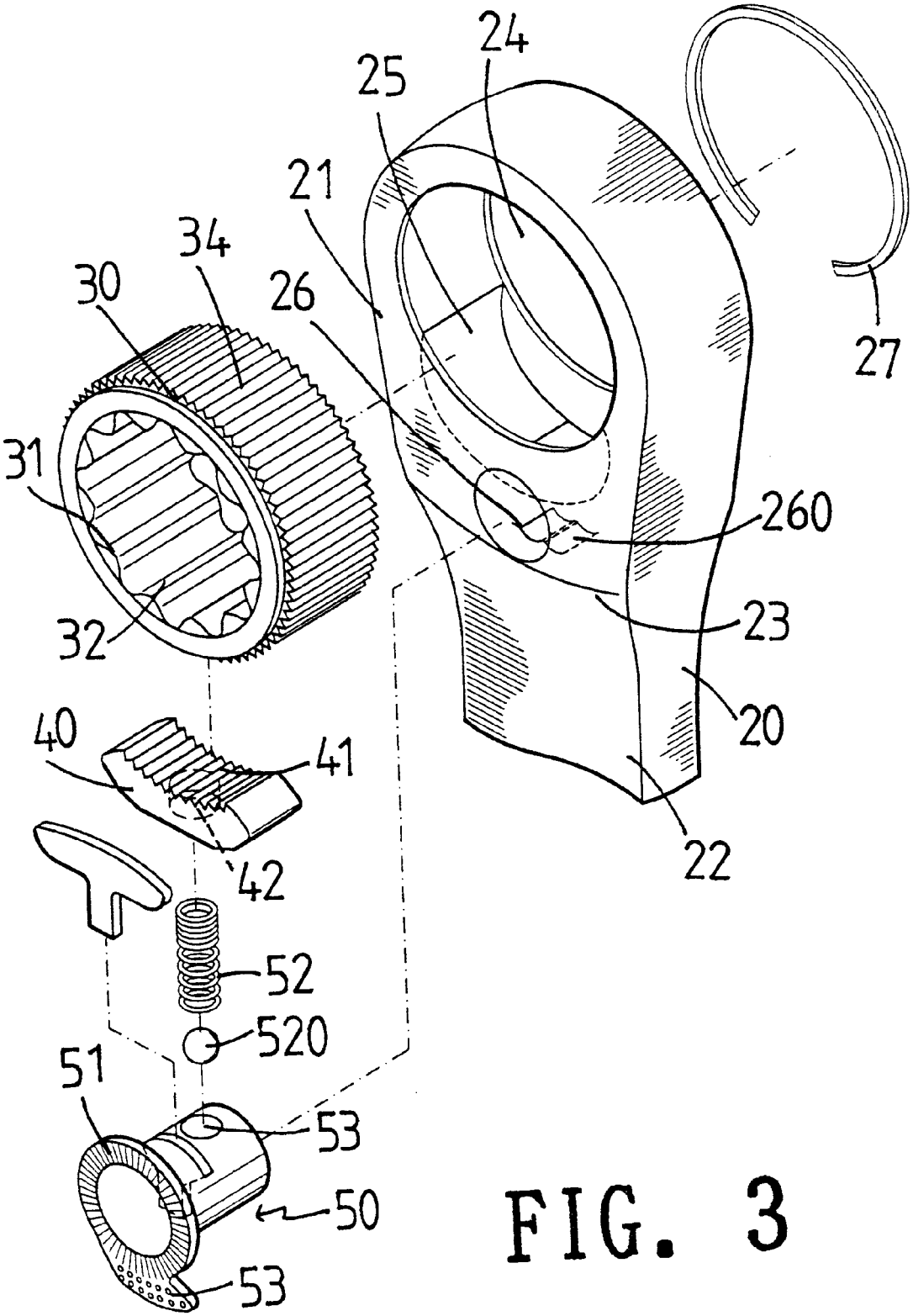
FIG. 3 is an exploded view to show the ratchet mechanism of the ratchet tool of the present invention.
Figure 4:
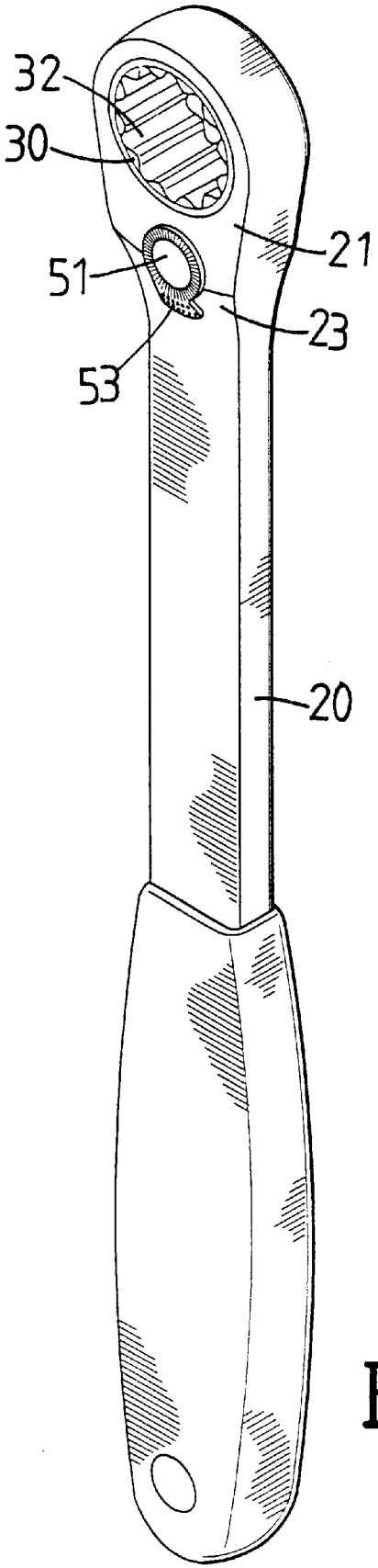
FIG. 4 is a perspective view to show the ratchet tool of the present invention.
Figure 5:
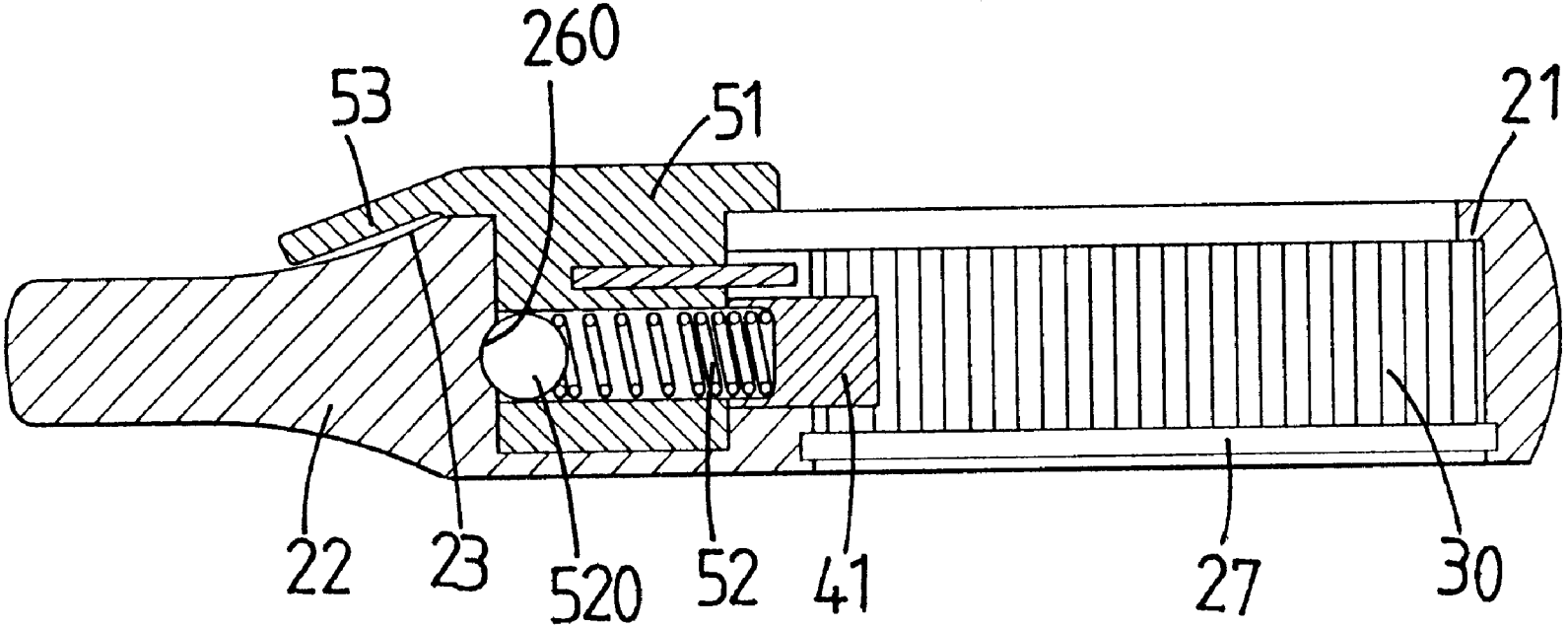
FIG. 5 shows a cross sectional view to show the ratchet tool of the present invention.

Referring to FIGS. 3 to 5, the ratchet tool 20 of the present invention comprises a head 21 having a through hole 24 defined therethrough and a recess 25 is defined in an inner periphery of the through hole 4. An operation recess 26 is defined in a side of the head 21 and communicates with the recess 25. An engaging ring 30 is rotatably received in the through hole 24 and a C-shaped clamp 27 is sued to retain the engaging ring 30 in the through hole 24. The engaging ring 30 has a toothed outer periphery 34 and a polygonal inner periphery which is composed of ridges 32 and grooves 31 so as to clamp a polygonal object such as a nut.

A pawl 40 is movably received in the recess 25 and has a toothed side 41 which is engaged with the toothed periphery 34 of the engaging ring 30. A notch 42 is defined in a side opposite to the toothed side 41.

A switch member 50 has a cylindrical portion inserted in the operation recess 26 and a passage 53 is defined radially in the cylindrical portion of the switch member 50. A spring 52 and a bead 520 are received in the passage 53 and one end of the spring 52 is engaged with the notch 42 in the pawl 40 and the other end of the spring 52 biases the bead 520 which is engaged with one of two concavities 260 defined in an inner periphery of the operation recess 26. A top plate 51 is connected to an end of the cylindrical portion of the switch member 50 and a diameter of the top plate 51 is larger than that of the operation recess 26 so as to cover the operation recess 26. A lever 53 extends from the top plate 51 at an angle.

A height difference is defined between an outside of the head 21 and a neck 22. A ramp 23 is connected between the outside of the head 21 and the neck 22 of the tool 20. The ramp 23 is tilt relative to the outside of the head 21 and the neck 22. The lever 53 is located in parallel with the ramp 23 with a tiny gap defined therebetween.

The operation recess 26 is covered by the top plate 51 and the lever 53 is located parallel with the tilt ramp 23 such that the grease and dust are not easily to be accumulated around the operation recess 26 which is not stocked by the grease and dust.

While we have shown and described the embodiment in accordance with the present invention, it should be clear to those skilled in the art that further embodiments may be made without departing from the scope of the present invention.

What is claimed is:

1. A ratchet tool comprising:

a head having a through hole defined therethrough and a recess defined in an inner periphery of the through hole, an operation recess defined in a side of the head and communicating with the recess, a height difference being defined between an outside of the head and a neck, a ramp connected between the outside of the head and the neck of the tool, the ramp being tilt relative to the outside of the head and the neck;

an engaging ring rotatably received in the through hole and having a toothed outer periphery;

a pawl movably received in the recess and having a toothed side which is engaged with the toothed periphery of the engaging ring, and a switch member having a cylindrical portion inserted in the operation recess and a passage defined radially in the cylindrical portion of the switch member, a spring and a bead received in the passage, the spring engaged with a notch defined in a side of the pawl opposite to the toothed side, the bead engaged with one of two concavities defined in an inner periphery of the operation recess, a top plate connected to an end of the cylindrical portion of the switch member and a diameter of the top plate being larger than that of the operation recess so as to cover the operation recess, a lever extending from the top plate at an angle such that the lever is located in parallel with the ramp with a tiny gap defined therebetween.

* * * * *